US007411145B1

(12) United States Patent
Jones et al.

(10) Patent No.: US 7,411,145 B1
(45) Date of Patent: Aug. 12, 2008

(54) MOTOR OPERATOR DE-COUPLING SYSTEM SENSING CAMSHAFT POSITION

(75) Inventors: William J. Jones, Cranberry Township, PA (US); Erik R. Bogdon, Carnegie, PA (US); Craig A. Rodgers, Butler, PA (US); Paul R. Rakus, Beaver Falls, PA (US); James M. Smeltzer, Salem, OH (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/733,465

(22) Filed: Apr. 10, 2007

(51) Int. Cl.
*H01H 5/00* (2006.01)

(52) U.S. Cl. ..... 200/400; 200/401; 335/6; 335/21; 335/167; 335/171; 335/189

(58) Field of Classification Search ..... 335/6, 335/8, 21, 22, 26–30, 167, 168, 171, 185, 335/189–192, 194, 195; 200/17 R, 400, 200/401, 500, 501
See application file for complete search history.

(56) References Cited

U.S. PATENT DOCUMENTS 2,846,621 A * 8/1958 Coggeshall et al. ..... 361/114
3,235,044 A * 2/1966 Rodeseike ..... 192/12 R
5,280,258 A * 1/1994 Opperthauser ..... 335/172
6,472,627 B1 * 10/2002 Yoon ..... 200/400

FOREIGN PATENT DOCUMENTS

JP 03201327 A * 9/1991

* cited by examiner

*Primary Examiner*—Ramon M Barrera
(74) *Attorney, Agent, or Firm*—Martin J. Moran

(57) ABSTRACT

A decoupling assembly structured to decouple the charging motor and the charging assembly cam shaft is provided. The decoupling assembly includes a lifter pin assembly and an elongated second end to a link member in the over-running clutch assembly. The link member supports a pawl which engages an over-running clutch assembly sprocket. The pawl is disposed on one side of a link member that is pivotally attached to an over-running clutch assembly hub assembly. The link member is structured to pivot in a "see-saw" like manner and thereby move the pawl between a first position, wherein the pawl engages the sprocket, and a second position, wherein the pawl does not engage the sprocket. The lifter pin assembly includes a spring loaded lifter pin that is structured to engage the link member second end and thereby move the pawl between the first position and the second position.

20 Claims, 6 Drawing Sheets

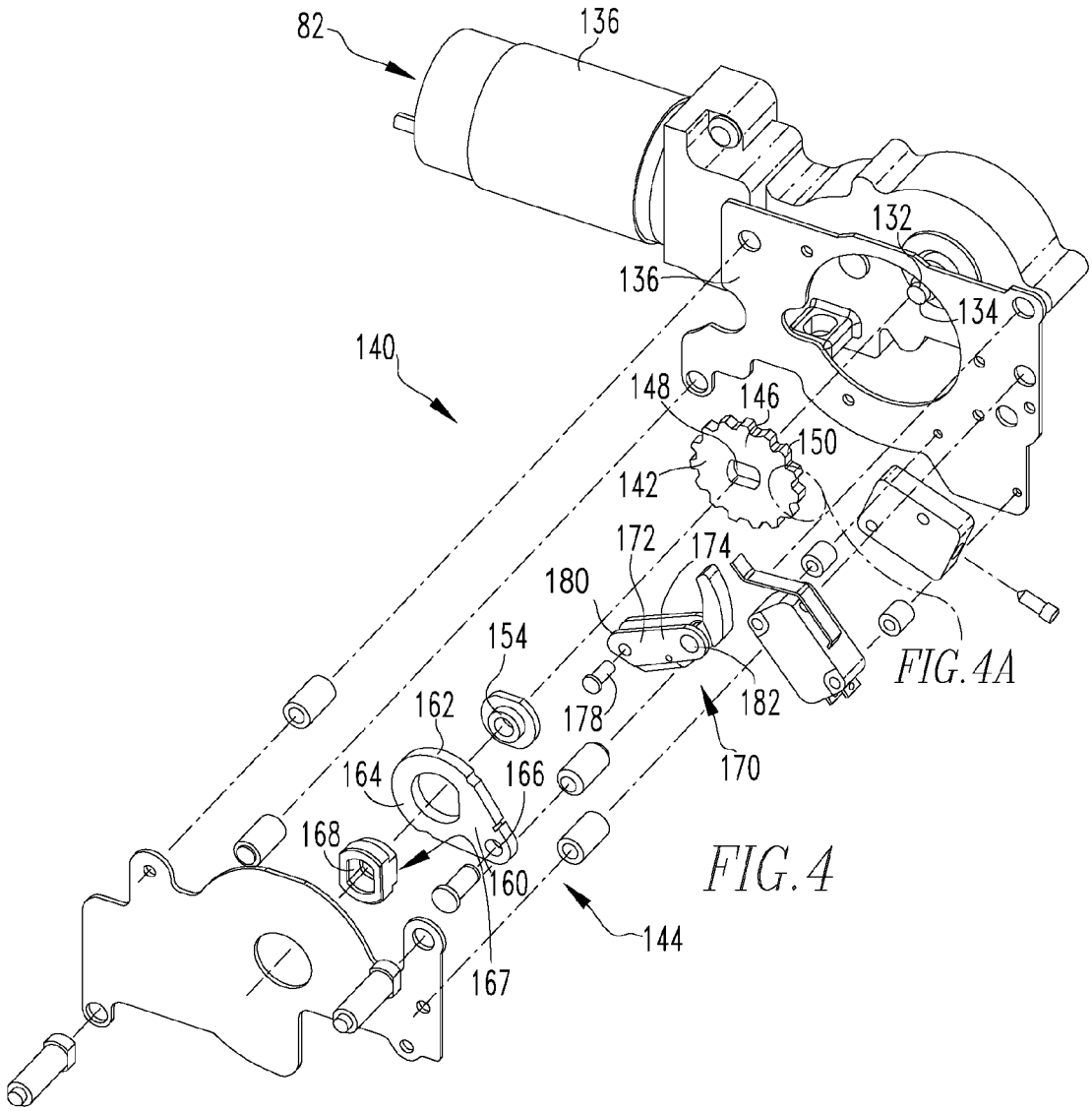
FIG. 4A
FIG. 4
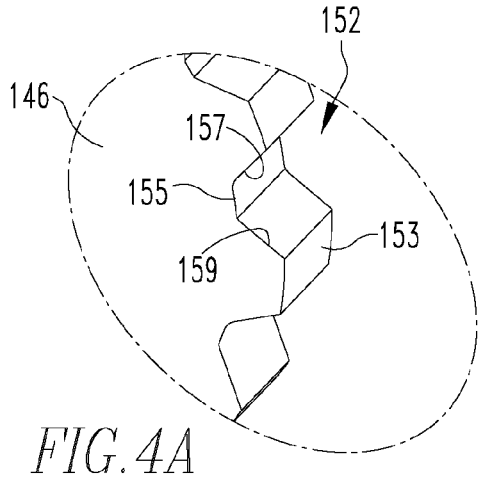
FIG. 4A

MOTOR OPERATOR DE-COUPLING SYSTEM SENSING CAMSHAFT POSITION

CROSS REFERENCE TO RELATED APPLICATION

This application is related to commonly assigned, concurrently filed U.S. patent application Ser. No. 10/733,449, filed Apr. 10, 2007, entitled "OVER RUNNING CLUTCH FOR A DIRECT DRIVE MOTOR OPERATOR," and which is incorporated by reference.

BACKGROUND OF THE INVENTION

1. Field of the Invention

The present invention relates to an electrical switching apparatus operating mechanism and, more specifically to a decoupling assembly disposed between the charging assembly motor and the charging assembly cam shaft structured to decouple the charging assembly motor and the charging assembly cam shaft in the event the charging motor fails to stop rotating.

2. Background Information

An electrical switching apparatus, typically, includes a housing, at least one bus assembly having a pair of contacts, a trip device, and an operating mechanism. The housing assembly is structured to insulate and enclose the other components. The at least one pair of contacts include a fixed contact and a movable contact and typically include multiple pairs of fixed and movable contacts. Each contact is coupled to, and in electrical communication with, a conductive bus that is further coupled to, and in electrical communication with, a line or a load. A trip device is structured to detect an over current condition and to actuate the operating mechanism. An operating mechanism is structured to both open the contacts, either manually or following actuation by the trip device, and close the contacts.

That is, the operating mechanism includes both a closing assembly and an opening assembly, which may have common elements, that are structured to move the movable contact between a first, open position, wherein the contacts are separated, and a second, closed position, wherein the contacts are coupled and in electrical communication. The operating mechanism includes a rotatable pole shaft that is coupled to the movable contact and structured to move each movable contact between the closed position and the open position. Elements of both the closing assembly and the opening assembly are coupled to the pole shaft so as to effect the closing and opening of the contacts.

An electrical switching apparatus typically had a stored energy device, such as at least one opening spring, and at least one link coupled to the pole shaft. The at least one link, typically, included two links that acted cooperatively as a toggle assembly. When the contacts were open, the toggle assembly was in a first, collapsed configuration and, conversely, when the contacts were closed, the toggle assembly was, typically, in a second, toggle position or in a slightly over-toggle position. The spring biased the toggle assembly to the collapsed position. The spring and toggle assembly were maintained in the second, toggle position by the trip device.

The trip device included an over-current sensor, a latch assembly and may have included one or more additional links that were coupled to the toggle assembly. Alternately, the latch assembly was directly coupled to the toggle assembly. When an over-current situation occurred, the latch assembly was released allowing the opening spring to cause the toggle assembly to collapse. When the toggle assembly collapsed, the toggle assembly link coupled to the pole shaft caused the pole shaft to rotate and thereby move the movable contacts into the open position.

Typically, the force required to close the contacts was, and is, greater than what a human may apply. As such, the operating mechanism typically included a mechanical closing assembly to close the contacts. The closing assembly, typically, included at least one stored energy device, such as a spring, and/or a motor. A common configuration included a motor that compressed one or more springs in the closing assembly. That is, the closing springs were coupled to a cam roller that engaged a cam coupled to the motor. As the motor rotated the cam, the closing springs were compressed or charged. The closing springs were maintained in the compressed configuration by a latch assembly. The latch assembly was actuated by a user to initiate a closing procedure. The closing assembly is structured to apply the energy stored in the springs to the toggle assembly so as to cause the pole shaft to rotate and close the contacts.

In many electrical switching apparatuses the springs are coupled to the toggle assembly via a cam roller. That is, the toggle assembly also included a cam roller, typically at the toggle joint. The closing assembly further included one or more cams disposed on a common cam shaft with the closing spring cam. Alternatively, depending upon the configuration of the cam, both the closing spring cam roller and the toggle assembly cam roller could engage the same cam. When the closing springs were released, the closing spring cam roller applied force to the associated cam and caused the cam shaft to rotate. Rotation of the cam shaft would also cause the cam associated with the toggle assembly cam roller to rotate. As the cam associated with the toggle assembly cam roller rotated, the cam caused the toggle assembly cam roller, and therefore the toggle assembly, to be moved into selected positions and/or configurations. Alternatively, as set forth in U.S. patent application Ser. No. 11/693,159, which is incorporated by reference, the springs could be coupled to a ram assembly having a ram body that moved over a predetermined path. The ram body was structured to directly engage the toggle assembly and move the toggle assembly into a selected position. That is, whether the closing assembly utilized a cam or a ram assembly, the toggle assembly was moved so as to rotate the pole shaft into a position wherein the contacts were closed.

For example, during a closing procedure the toggle assembly would initially be collapsed and, therefore, the contacts were open. When the closing springs were released, the rotation of the cam associated with the toggle assembly cam roller would cause the toggle assembly to move back into the second, toggle position, thereby closing the contacts. This motion would also charge the opening springs. Simultaneously, or near simultaneously, the trip device latch would be reset thereby holding the toggle assembly in the second, toggle position. After the contacts were closed, it was common to recharge the closing spring so that, following an over current trip, the contacts could be rapidly closed again. That is, if the closing springs were charged, the contacts could be closed almost immediately without having to wait to charge the closing springs.

As noted above, the charging of the closing springs was typically accomplished via a motor. The motor had an output shaft that was coupled, directly or indirectly, to the shaft of the charging cam. In addition to the charging motor, most electrical switching apparatuses included an elongated manual charging handle. The charging handle also acted upon the shaft of the charging cam either directly or indirectly.

As set forth in U.S. patent application Ser. No. 10/733,449, filed Apr. 10, 2007, entitled "OVER RUNNING CLUTCH FOR A DIRECT DRIVE MOTOR OPERATOR", an over-running clutch assembly for an electrical switching apparatus is provided. The over running clutch assembly includes a sprocket and a hub assembly. The hub assembly is rotatably coupled to the sprocket and structured to rotate in a charging direction relative to the sprocket. The sprocket is fixed to a motor shaft. The hub assembly is structured to be disengagably fixed to a cam shaft in the charging assembly. A manual charging handle is also coupled to the cam shaft and is structured to rotate the cam shaft in a charging direction. In this configuration, an operator may charge the closing springs of the electrical switching apparatus using either the handle assembly or the motor. When the handle assembly is used to charge the closing springs, the cam shaft causes the hub assembly to rotate over the sprocket. Thus, the rotation of the cam shaft is not transferred to the motor. When the motor is used, the motor turns both the sprocket and the hub assembly. The hub assembly transfers the rotational force from the motor to the cam shaft.

The over-running clutch assembly, however, is not structured to allow the hub assembly to disengage from the sprocket in the event of a failure to disengage the motor. That is, the charging assembly as disclosed in U.S. patent application Ser. No. 10/733,449, filed Apr. 10, 2007, entitled "OVER RUNNING CLUTCH FOR A DIRECT DRIVE MOTOR OPERATOR", as well as in U.S. patent application Ser. No. 11/693,159, which is incorporated by reference, provides for a latch assembly structured to latch the charging cam in a stop position when the closing springs are charged. Because the latch assembly locks the cam in place, at least until the latch assembly is released, any subsequent rotational force applied to the cam or the associated cam shaft is very likely to damage the electrical switching apparatus operating mechanism.

There is, therefore, a need for a decoupling assembly for a charging assembly for an electrical switching apparatus structured to decouple the charging motor and the charging assembly cam shaft.

There is a further need for a decoupling assembly for a charging assembly for an electrical switching apparatus that acts in concert with an over-running clutch assembly.

SUMMARY OF THE INVENTION

These needs, and others, are met by at least one embodiment of the disclosed invention which provides for a decoupling assembly which shares several components with the over running clutch assembly. The decoupling assembly includes a lifter pin assembly and an elongated second end to a link member in the over-running clutch assembly. The link member supports a pawl which engages the over-running clutch assembly sprocket. The pawl is disposed on one side of a link member that is pivotally attached to an over-running clutch assembly hub assembly. With the addition of the elongated second end to the link member, the link member is structured to pivot in a "see-saw" like manner and thereby move the pawl between a first position, wherein the pawl engages the sprocket, and a second position, wherein the pawl does not engage the sprocket. The lifter pin assembly includes a lifter pin that is structured to engage the link member second end and thereby move the pawl between the first position and the second position. The lifter pin assembly is structured to engage the link member just prior to the latch assembly engaging the cam. Thus, in this configuration, when the pawl is in the second position, the hub assembly "floats" on the sprocket. In the unlikely event that a motor cutoff switch fails to turn off the motor at the proper time, the decoupling assembly will decoupled the motor shaft from the cam shaft and any rotation of the motor shaft will not be transferred to the cam shaft.

BRIEF DESCRIPTION OF THE DRAWINGS

A full understanding of the invention can be gained from the following description of the preferred embodiments when read in conjunction with the accompanying drawings in which:

FIG. 2A shows the springs in a discharged position. FIG. 2B shows the springs in a charged position.

FIG. 4 shows an exploded view of an over running clutch assembly.

FIG. 4A is a detail of the sprocket.

DESCRIPTION OF THE PREFERRED EMBODIMENTS

As used herein, "float" means that one of two components that are coupled together remains generally stationary while the other component rotates. That is, the generally stationary component "floats" adjacent to the rotating component. "Float" does not mean that the two components do not touch. For example, although a phonograph needle touches a record, under this definition the needle "floats" on the record. That is, the needle remains generally stationary while the record rotates.

As used herein "functional engagement" and "initial engagement" mean, respectively, an engagement by a first component that causes a second component to move, and, an engagement by a first component that does not cause a second component to move. For example, a spring-biased first component may engage a second component. Initially, and during the initial compression of the spring, the first component "initially engages" but does not move the second component. As the first component moves and further compresses the spring, the bias of the spring will overcome the force holding the second component in place. When the bias of the spring is sufficient, the first component "functional engages" the second component and the second component moves.

As used herein, "coupled" means a link between two or more elements, whether direct or indirect, so long as a link occurs.

As used herein, "directly coupled" means that two elements are directly in contact with each other.

As used herein, "fixedly coupled" or "fixed" means that two components coupled to move as one. Components that are "fixed" to each other may be "permanently fixed" to each other by a coupling device such as, but not limited to, welding or a difficult to access bolt. Components may also be "disengagably fixed" to each other by a coupling device that, when joined, maintains the components in a set orientation relative to each other, but which may be decoupled. For example, a socket wrench typically includes a ratchet/handle with a rotatable square shaft structured to be disengagably fixed to a socket.

Figure 1:
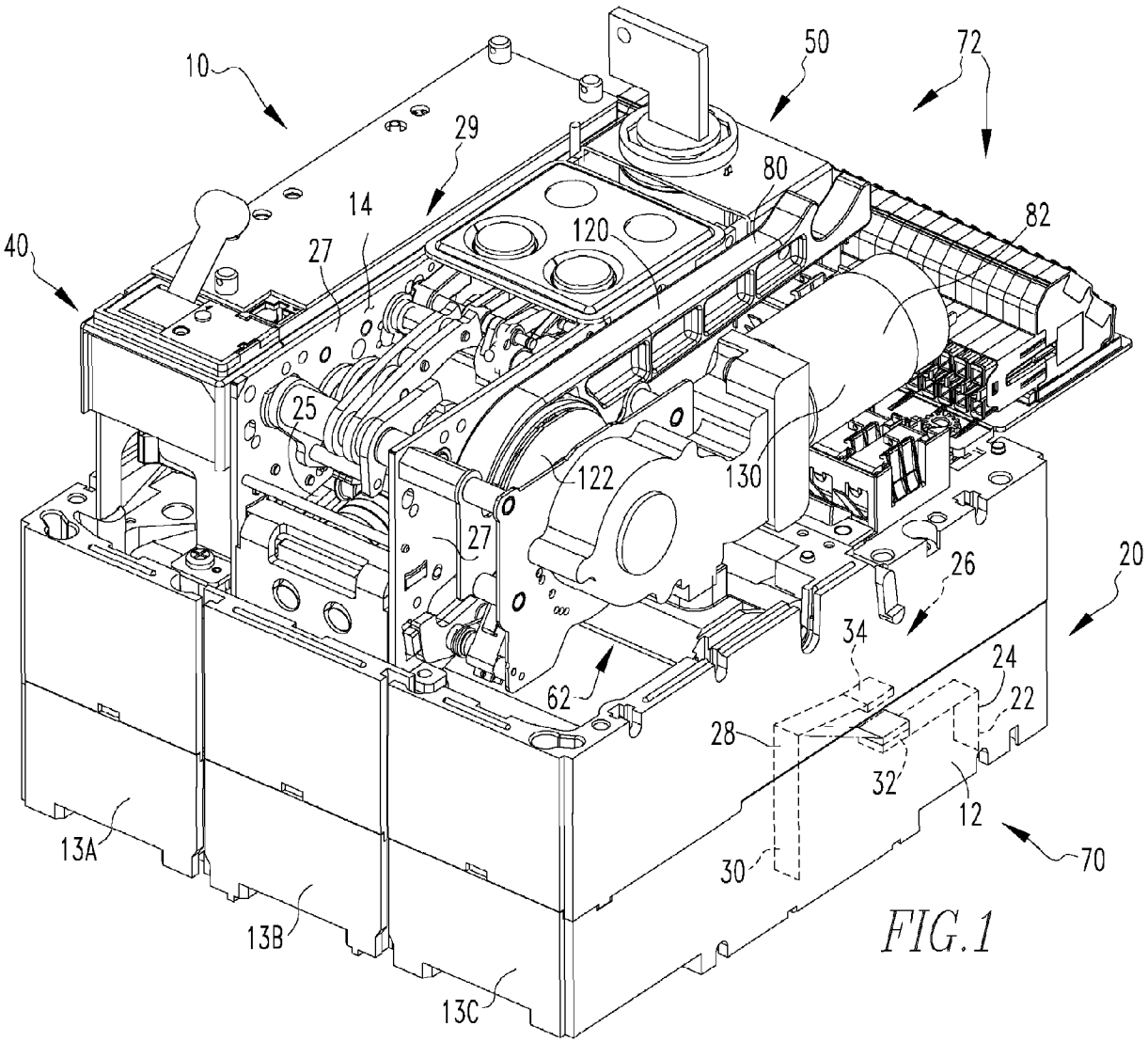
FIG. 1 is an isometric view of an electrical switching apparatus with a front cover removed.

As shown in FIG. 1, an electrical switching apparatus 10 includes a housing assembly 12 defining an enclosed space 14. In FIG. 1, the front cover of the housing assembly 12 is not shown, but it is well known in the art. The electrical switching apparatus 10 further includes a conductor assembly 20 (shown schematically) having at least one line terminal 22, at least one line conductor 24, at least one pair of separable contacts 26, at least one load conductor 28 and at least one load terminal 30. The at least one pair of separable contacts 26 include a fixed contact 32 and a movable contact 34. The movable contact 34 is structured to move between a first, open position, wherein the contacts 32, 34 are separated, and a second, closed position, wherein the contacts 32, 34 contact each other and are in electrical communication. The electrical switching apparatus 10 further includes a trip device 40 and an operating mechanism 50. The operating mechanism 50, which is discussed in more detail below, is generally structured to move the at least one pair of separable contacts 26 between the first, open position and the second, closed position. The trip device 40 is structured to detect an over current condition and, upon detecting such a condition, to actuate the operating mechanism 50 to open the at least one pair of separable contacts 26.

The electrical switching apparatus 10 also includes at least two, and typically a plurality, of side plates 27. The side plates 27 are disposed within the housing assembly 12 in a generally parallel orientation. The side plates 27 include a plurality of openings 29 to which other components may be attached or through which other components may extend. As discussed below, the openings 29 on two adjacent side plates 27 are typically aligned. While side plates 27 are the preferred embodiment, it is understood that the housing assembly 12 may also be adapted to include the required openings and/or attachment points thereby, effectively, incorporating the side plates 27 into the housing assembly 12 (not shown).

An electrical switching apparatus 10 may have one or more poles, that is, one or more pairs of separable contacts 26 each having associated conductors and terminals. As shown in the Figures the housing assembly 12 includes three chambers 13A, 13B, 13C each enclosing a pair of separable contacts 26 with each being a pole for the electrical switching apparatus 10. A three-pole configuration, or a four-pole configuration having a neutral pole, is well known in the art. The operating mechanism 50 is structured to control all the pairs of separable contacts 26 within the electrical switching apparatus 10. Thus, it is understood selected elements of the operating mechanism 50, such as, but not limited to, the pole shaft 56 span all three chambers 13A, 13B, 13C and engage each pair of separable contacts 26. The following discussion, however, shall not specifically address each specific pair of separable contacts 26.

Figure 2:
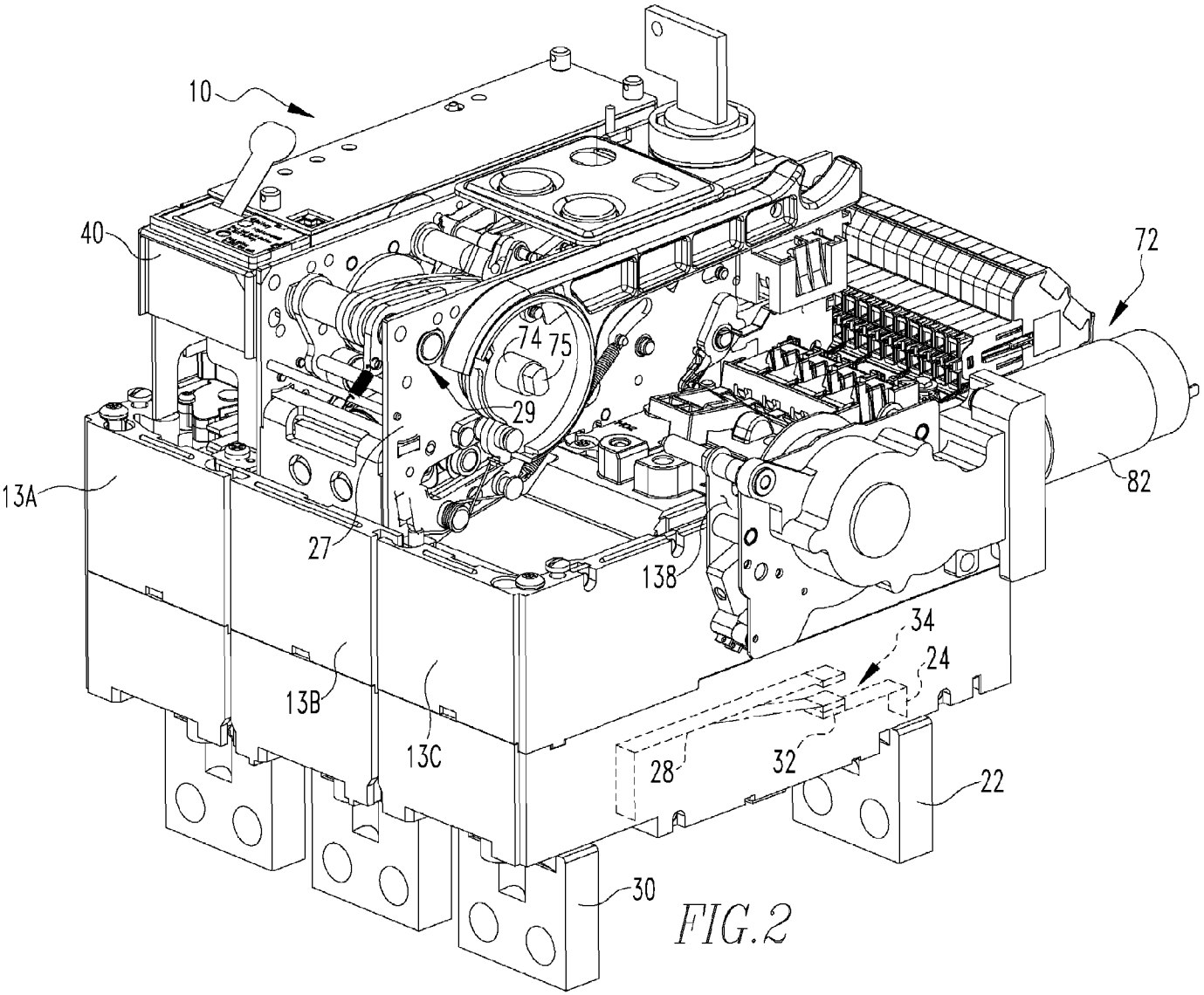
FIG. 2 is an isometric view of an electrical switching apparatus with a front cover, motor assembly and handle assembly removed.
Figure 3A:
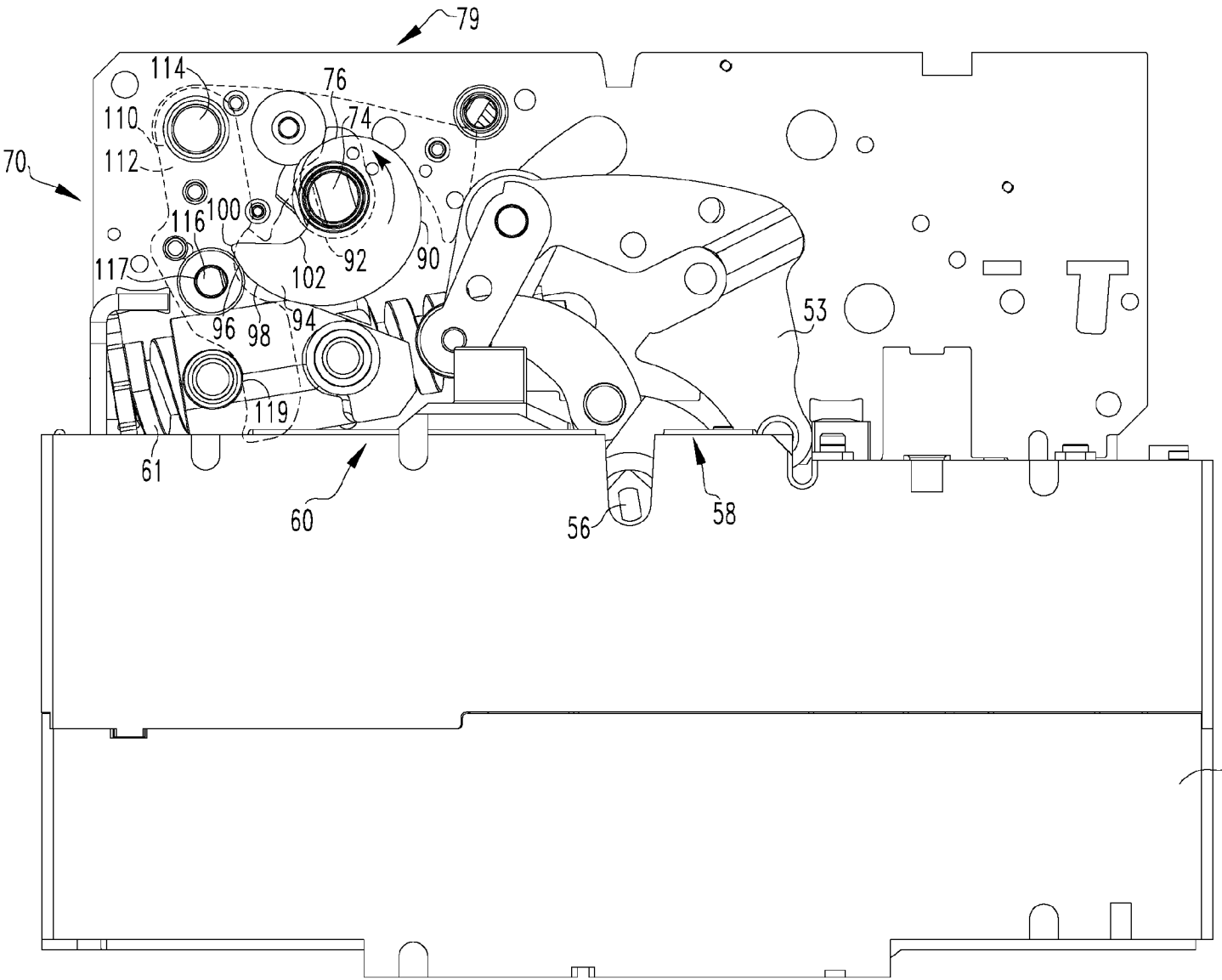
FIGS. 3A and 3B are side views of an electrical switching apparatus with a front cover removed and selected components removed for clarity.
Figure 3B:
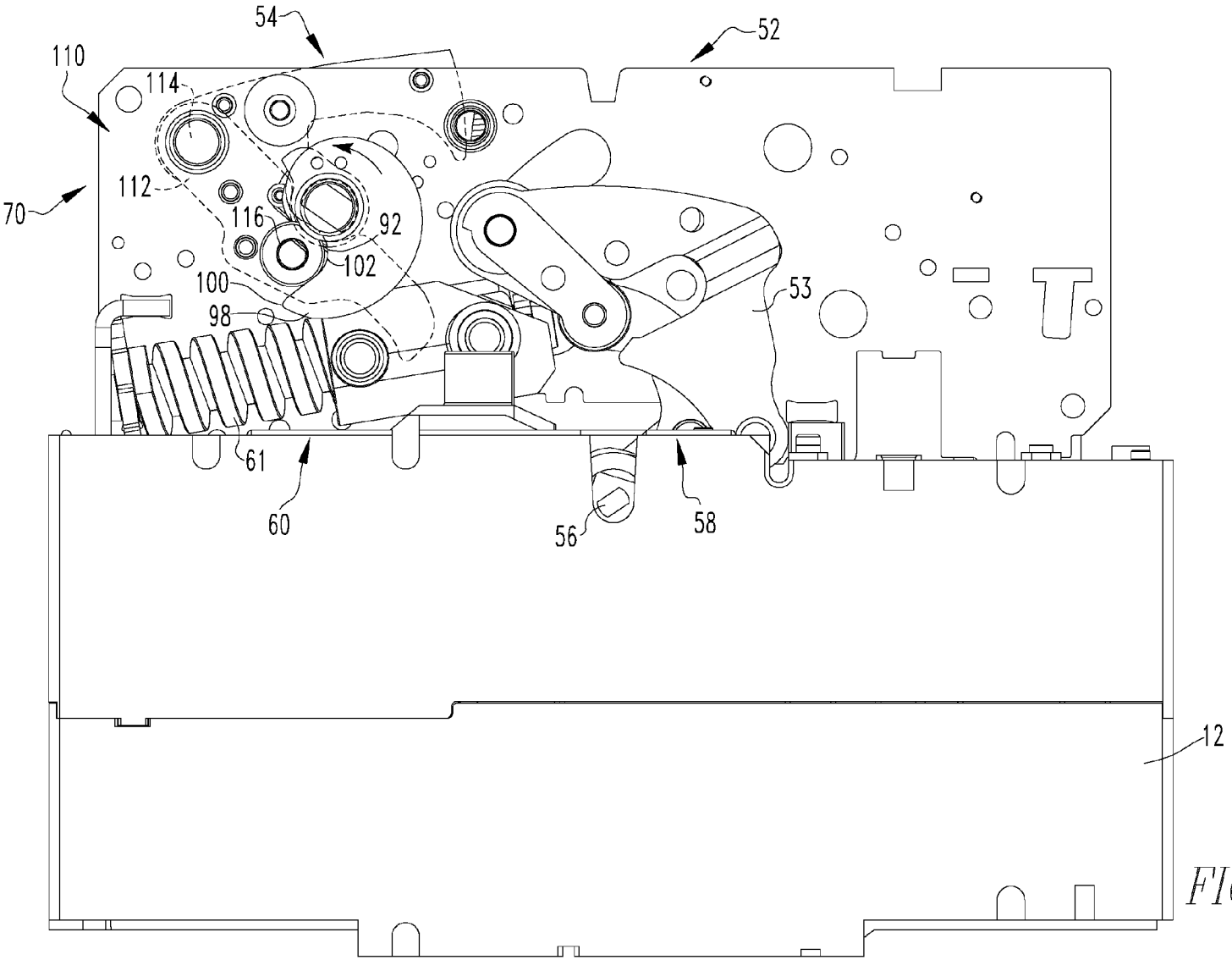
Figure 5:
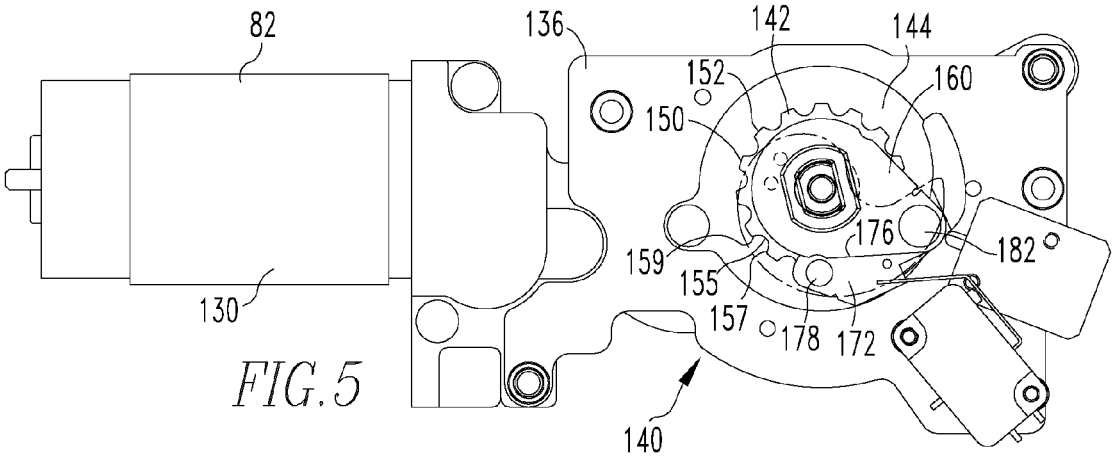
FIG. 5 shows an end view of selected components of the charging assembly.

As shown in FIG. 2, the operating mechanism 50 includes an opening assembly 52, structured to move the at least one pair of separable contacts 26 from the second, closed position to the first, open position, and a closing assembly 54, structured to move the at least one pair of separable contacts 26 from the first, open position to the second closed position. The opening assembly 52 and the closing assembly 54 both utilize common components of the operating mechanism 50. The opening assembly 52 is not part of the claimed invention, however, for the purpose of the following discussion, it is understood that the opening assembly 52 is the assembly structured to move various components to the positions discussed below. Further, it is noted that the opening assembly 52 includes a cradle assembly 53 that, among other functions, acts as a toggle stop and as a toggle kicker for the toggle assembly 58 (discussed below).

Further details relating to the operation of the closing assembly 54 are set forth in U.S. patent application Ser. No. 11/693,159, which, as noted above, is incorporated by reference. That is, as discussed in U.S. patent application Ser. No. 11/693,159, the closing assembly 54 utilizes a ram assembly 60 structured to act upon a toggle assembly 62 wherein the toggle assembly 62 is coupled via a pole shaft 56 to the movable contacts 34. The ram assembly 60 utilizes energy stored in at least one closing spring 61. The at least one closing spring 61 is structured to move between a charged and a discharged configuration. The at least one closing spring 61 is compressed, or "charged," by the charging assembly 70 detailed herein.

As shown in FIGS. 1 and 2, the charging assembly 70 includes a charging operator 72, a cam shaft 74, at least one cam 76, and a rocker arm assembly 110. The charging operator 72 is a device coupled to, and structured to rotate, the cam shaft 74. The charging operator 72, preferably, includes both a manually powered handle assembly 80 and a powered motor assembly 82 as shown in FIG. 1. The cam shaft 74 is an elongated shaft that is rotatably coupled to the housing assembly 12 and/or side plates 27. The at least one cam 76 is fixed to the cam shaft 74 and structured to rotate therewith about a pivot point. The cam shaft 74 has a distal tip 75 that is spaced from the least one cam 76. The cam shaft distal tip 75 has a non-circular shape which is, preferably a D-shape as shown.

The at least one cam 76, which hereinafter will be referred to as a single cam, includes an outer cam surface 90. The outer cam surface 90 has a point of minimal diameter 92, a point of greatest diameter 94, also known as "top dead center" of the cam 76, and a stop diameter 96. The cam 76 is structured to rotate in a single direction as indicated by the arrow in FIG. 2. The outer cam surface 90 increases gradually in diameter from the point of minimal diameter 92 to the point of greatest diameter 94, also known as top dead center, in the direction of rotation. After the cam point of greatest diameter 94, the diameter of the outer cam surface 90 is reduced slightly over a downslope 98. The downslope 98 leads to the stop diameter 96 and then a tip 100. As set forth in U.S. patent application Ser. No. 11/693,159, the downslope 98 to the stop diameter 96 is a surface to which the force from the at least one closing spring 61 is applied and which encourages rotation in the proper direction so that when the close latch assembly 79 is released, the cam shaft 74 rotates from the stop diameter 96 to the cam tip 100 where the cam follower 116 falls off the cam tip 100 and into the pocket of the cam 76. As is shown, the outer cam surface point of minimal diameter 92 and the outer cam tip 100 are disposed immediately adjacent to each other on the outer cam surface 90. Thus, there is a step 102 between the point of minimal diameter 92 and the cam tip 100. It is further noted that, due to the diameter of the cam follower 116 (discussed below) the cam follower 116 does not engage the point of minimal diameter 92, but rather engages a location immediately adjacent to the point of minimal diameter 92.

The rocker arm assembly 110 includes an elongated body 112 having a pivot point 114, a cam follower 116, and a ram body contact point 118. The rocker arm assembly body 112 is pivotally coupled to housing assembly 12 and/or side plates 27 at the rocker arm body pivot point 114. The rocker arm assembly body 112 may rotate about the rocker arm body pivot point 114 and is structured to move between a first position, wherein the rocker arm body ram body contact point 118 is disposed adjacent to a ram assembly base plate, and a second position, wherein the rocker arm body ram body contact point 118 is adjacent to a ram assembly stop plate. As used immediately above, "adjacent" is a comparative adjective relating to the positions of the rocker arm assembly body 112. The rocker arm body ram body contact point 118 is structured to engage and move the ram assembly 60 and thereby compress the at least one closing spring 61. The rocker arm assembly body 112 moves within a plane generally parallel to the plane of the side plates 27. The rocker arm body cam follower 116 extends generally perpendicular to the longitudinal axis of the rocker arm assembly body 112 and is structured to engage the outer cam surface 90. The rocker arm body cam follower 116 may include a roller 117. Thus, charging of the at least one closing spring 61 is accomplished by the rotation of the cam 76. The rotation of the cam 76 is arrested by a latch assembly 79 when the rocker arm body cam follower 116 is at the stop diameter 96 as discussed in U.S. patent application Ser. No. 11/693,159.

Rotation of the cam 76 is accomplished by using the handle assembly 80 or the motor assembly 82. The handle assembly 80 is coupled to the cam shaft 74 at a point between the cam shaft distal tip 75 and the at least one cam 76. The handle assembly 80 includes an elongated handle 120 and a ratchet assembly 122. As is known in the art, the handle 120 is coupled to the ratchet assembly 122. The ratchet assembly 122 is coupled to the cam shaft 74 and structured to rotate the cam shaft 74 in the charging direction (as indicated by the arrow on FIG. 2A). That is, the ratchet assembly 122 includes a rack of teeth (not shown) and a pawl (not shown). The rack of teeth is coupled, or fixed, to the cam shaft 74. The pawl is coupled to the handle 120 and, when the handle 120 is moved in a first direction, the pawl passes over the rack of teeth. When the handle 120 is moved in the opposite direction, the pawl engages the rack of teeth and causes the cam shaft 74 to rotate in the charging direction.

The motor assembly 82 includes a motor 130 and a shaft 132. The motor 130 is structured to rotate the motor shaft 132 in the charging direction. The motor shaft 132 has a distal end 134. When the motor assembly 82 is installed in the housing assembly 12, the axis of the motor shaft 132 is aligned with the cam shaft 74 with the motor shaft distal end 134 adjacent to the cam shaft distal tip 75. The motor shaft 132 and the cam shaft 74 are coupled by an over running clutch assembly 140, discussed below. The motor assembly 82 may include two side plates 136 which are held in a spaced relation and which define a clutch space 138. The over running clutch assembly 140 is disposed in the clutch space 138 and is removable from the housing assembly 12 with the motor assembly 82. The motor assembly 82 preferably includes an electronic cutoff switch 139.

The charging assembly 70 also includes an over running clutch assembly 140. The over running clutch assembly 140 includes a sprocket 142 and a hub assembly 144. The sprocket 142 is structured to be fixed to the motor shaft distal end 134. The sprocket 142 has a generally flat, disk-like body 146 having a central opening 148 and a radial outer surface 150 having a number of generally uniform teeth 152. Preferably, the teeth 152 are symmetrical about a central point having a generally smooth top 153 and a generally U-shaped sidewall 155 between the teeth tops 153. The U-shaped sidewall 155 has a descending side 157 and an ascending side 159, as described below. The teeth 152 may also be jagged (not shown) in a manner similar to the teeth 152 on a ratchet rack. The sprocket central opening 148, preferably, has a non-circular shape, such as a D shape as shown. The motor shaft 132 has a shape corresponding to the shape of the sprocket central opening 148 and, as such, when the sprocket 142 is coupled to the motor shaft 132 with the motor shaft 132 extending into, or through, the sprocket central opening 148, the sprocket 142 is fixed to the motor shaft 132 and rotates therewith. The sprocket 142 also includes a collar 154. The collar 154 is, essentially, a circular cap that is disposed over the end of the motor shaft 132.

The hub assembly 144 is structured to be disengagably fixed to the cam shaft 74 and rotatably coupled to the sprocket 142. The hub assembly 144 includes a hub body 160 and a link assembly 170. The hub body 160 is generally planar with a first face 162 and a second face 164. The hub body 160 further includes a link assembly mounting point 166, a sprocket socket 167, and a cam shaft socket 168. The sprocket socket 167 is disposed on the first face 162. The sprocket socket 167 is generally circular and sized to correspond to the size of the collar 154. That is, the collar 154 may be rotatably disposed within the sprocket socket 167. The cam shaft socket 168 is disposed on the second face 164. The cam shaft socket 168 has a shape that corresponds to the shape of the cam shaft distal tip 75 which, as shown, is preferably a D shape. The center of the sprocket socket 167 and the center of the cam shaft socket 168 are aligned and define an axis of rotation for the hub body 160.

The link assembly 170 includes a link member 172 having an elongated body 174, a spring 176 and a pawl 178. The link member elongated body 174 has a first end 180 and a pivot mounting 182. The link member elongated body 174, as described below, is coupled to the hub body 160 and the longitudinal axis of the link member elongated body 174 extends in a plane generally parallel to the plane of the hub body 160. The pawl 178 is disposed at the link member body first end 180. The pawl 178 extends in a direction generally perpendicular to the plane of the hub body 160.

The hub assembly 144 is assembled as follows. The link member elongated body 174 is pivotally coupled to the hub body 160. More specifically, the link member elongated body pivot mounting 182 is coupled to the link assembly mounting point 166. The link assembly spring 176 is disposed between, and coupled to both, the link member elongated body 174 and the hub body 160. The link assembly spring 176 is structured to bias the link member body first end 180 towards the hub body 160. Thus, the pawl 178 is also biased toward the hub body 160. Thus, the pawl 178, as well as the link member 172, is structured to move between a first position, wherein the pawl 178 engages the sprocket radial outer surface 150, and a second position, wherein the pawl 178 does not engage the sprocket radial outer surface 150. Movement of the pawl 178 into the second position is detailed below. As set forth below, when the pawl 178 is in the first position, the pawl 178 may move over the sprocket radial outer surface 150 when the hub assembly 144 is rotated in the charging direction.

The over running clutch assembly 140 is assembled as follows. The hub assembly 144 is rotatably coupled to the sprocket 142. That is, the collar 154 is disposed within the sprocket socket 167. Because the collar 154 and the sprocket socket 167 are both generally circular, the hub assembly 144 may rotate relative to the sprocket 142. The hub body 160 and the sprocket body 146 extend, generally, in parallel planes. Thus, the pawl 178 extends perpendicularly toward the sprocket body 146 and engages the teeth 152. Further, relative to the charging direction, the link assembly mounting point 166 is disposed behind the pawl 178. The link assembly mounting point 166 is also disposed so that, when the pawl 178 is disposed between the sprocket teeth tops 153, that is, when the pawl 178 is disposed over the U-shaped sidewall 155 between the teeth tops 153, a line extending between the link assembly mounting point 166 and the pawl 178 intersects the descending side 157 of the U-shaped sidewall 155 where the pawl 178 is located.

In this configuration, the hub assembly 144 may only rotate in the charging direction relative to the sprocket 142. That is, the pawl 178 moves over the sprocket outer surface 150 in a single direction, the charging direction. Given this direction of motion of the pawl 178, the U-shaped sidewall 155 may be said to have a descending side 157 and an ascending side 159. As the pawl 178 moves over a tooth top 153 and enters the U-shaped sidewall 155, the pawl 178 "descends" over the descending side 157. When the pawl 178 moves out of the U-shaped sidewall 155, the pawl 178 "ascends" over the ascending side 159. It is noted that, due to the position of the link assembly mounting point 166, as described above, the descending side 157 is generally perpendicular to the line extending between the link assembly mounting point 166 and the pawl 178. However, due to the curvature of the sprocket 142, the line extending between the link assembly mounting point 166 and the pawl 178 may not cross over the ascending side 159, or, if the line extending between the link assembly mounting point 166 and the pawl 178 does cross over the ascending side 159, the line does so at an angle of less than about 80 degrees.

Thus, when a rotational force is applied to the hub assembly 144 in the charging direction, the force applied to the link member elongated body 174 overcomes the bias of the link assembly spring 176 and the pawl 178 moves over the sprocket outer surface 150. More specifically, the rotational force causes a force on the pawl 178 that acts along the line extending between the link assembly mounting point 166 and the pawl 178. When the rotation force is applied in the charging direction, the resulting force on the pawl 178 acts in a direction away from the link assembly mounting point 166. Because this force is acting along a line that does not intersect, or intersects at an angle, the ascending side 159, the pawl 178 may move over the sprocket outer surface 150. Thus, when a rotational force in the charging direction is applied to the hub assembly 144, e.g. a force created by a user operating the handle assembly 80, the hub assembly 144 rotates in the charging direction relative to the sprocket 142.

When a rotational force is applied to the hub assembly 144 opposite the charging direction, the force applied to the link member elongated body 174 does not overcome the bias of the link assembly spring 176 and the pawl 178 cannot move over the sprocket outer surface 150. That is, due to the position of the link assembly mounting point 166, as set forth above, a rotational force applied to the hub assembly 144 in a direction opposite the charging direction causes the pawl 178 to engage, or be pulled against, the U-shaped sidewall 155 where the pawl 178 is located. That is, the force on the pawl 178 acts in a line between the pawl 178 and the link assembly mounting point 166. As set forth above, this line intersects the descending side 157 at about a right angle. Thus, the force is, essentially, directed into the sprocket 142 and as such, the force cannot overcome the bias of the link assembly spring 176 and the pawl 178 cannot move out of the U-shaped sidewall 155. It is further noted that when the sprocket 142 is rotated by the motor 130 in the charging direction, the forces applied to the hub assembly 144 are similar to applying a rotational force to the hub assembly 144 opposite the charging direction. Thus, when the motor 130 rotates the sprocket 142, the hub assembly 144 rotates with the sprocket 142 in the charging direction.

As noted above, the cam shaft socket 168 and the cam shaft distal tip 75 have corresponding shapes, preferably a D shape. The cam shaft distal tip 75 may be inserted, or removed, from the cam shaft socket 168. Because the cam shaft socket 168 and the cam shaft distal tip 75 are non-circular, when the components are coupled, the components will move in a fixed orientation relative to each other. That is, the cam shaft socket 168 may be disengagably fixed to the cam shaft distal tip 75. Alternately stated, the cam shaft 74 is disengagably fixed to the hub assembly 144. Thus, the motor assembly 82 and the over running clutch assembly 140 may be removed or installed as a unit from the housing assembly 12.

In operation, in this configuration, the handle assembly 80 is structured to rotate the cam shaft 74 and the hub assembly 144, with the hub assembly 144 rotating on the sprocket 142. Further, the motor assembly 82 is structured to rotate the cam shaft 74, the hub assembly 144 and the sprocket 142, with the hub assembly 144 rotating with the sprocket 142.

The charging assembly 70 also includes a decoupling assembly 200 which shares several components with the over running clutch assembly 140. More specifically, as shown in FIG. 4, the decoupling assembly 200 includes the sprocket 142 and the hub assembly 144, as well as, a lifter pin assembly 220. The hub assembly 144, and more specifically the link member 172, is structured with a second end 212. The link member second end 212 is elongated and disposed on the opposite side of the link member pivot mounting 182 from the link member first end 180. The link member second end 212 preferably has an arcuate outer surface 214.

The lifter pin assembly 220 includes a lifter pin 222, a lifter pin spring 224, a mounting 226 and, preferably a lifter pin housing 228. The lifter pin spring 224 is disposed between the lifter pin 222 and the mounting 226 and is structured to bias the lifter pin 222 away from the mounting 226. The lifter pin spring 224 and the mounting 226 are disposed inside the lifter pin housing 228 with the lifter pin 222 extending through a passage in the lifter pin housing 228. The lifter pin assembly 220 is disposed on a motor assembly side plate 136 adjacent to the hub assembly 144.

The decoupling assembly 200 is structured to decouple the motor shaft 132 from the cam shaft 74 for events such as the motor assembly electronic cutoff switch 139 failing to operate. As set forth above, the rotation of the cam 76 is arrested by a latch assembly 79 when the rocker arm body cam follower 116 is at the stop diameter 96. As further noted above, the downslope 98 to the stop diameter 96 is a surface to which the force from the at least one closing spring 61 is applied and which encourages rotation in the proper direction so that when the close latch assembly 79 is released. That is, during a charging operation, the rocker arm assembly 110 engages the cam 76. As the cam 76 rotates, the rocker arm assembly 110 sequentially engages a location immediately adjacent to the point of minimal diameter 92, then the cam top dead center 94, then the downslope 98 and finally the stop diameter 96. As the rocker arm assembly 110 engages the cam 76 between the a location immediately adjacent to the point of minimal diameter 92 and the cam top dead center 94, the at least one closing spring 61 is being compressed. As such, a counter force is being applied to the rocker arm assembly 110 and the cam 76 as well as the rest of the charging assembly 70. Accordingly, a rotational force must be applied to the cam shaft 74 during this movement. The rotational force is typically applied to the cam shaft 74 by the motor assembly 82. Once the rocker arm assembly 110 moves past the cam top dead center 94 and onto the downslope 98, however, the at least one closing spring 61 is no longer being compressed and, in fact, expands slightly. The energy released by the at least one closing spring 61 is applied to the cam 76 and causes the cam 76 to rotate in the charging direction. When the rocker arm assembly 110 reaches the stop diameter 96, the latch assembly 79 prevents any further rotation of the cam 76. Accordingly, the motor assembly 82 is not required to rotate the cam 76 once the rocker arm assembly 110 moves past the cam top dead center 94 and, more importantly, the motor assembly 82 must not apply a rotational force to the cam once the latch assembly 79 prevents any further rotation of the cam 76.

As noted above, the hub assembly 144 is structured to be disengagably fixed to the cam shaft 74. As such, the hub assembly 144 moves in a fixed relationship with the cam 76. Thus, when the rocker arm assembly 110 engages a location immediately adjacent to the point of minimal diameter 92, it may be said that the hub assembly 144 is in a minimal diameter position. Further, when the rocker arm assembly 110 engages the cam top dead center 94, the hub assembly 144 is in a top dead center position. Similarly, when the rocker arm assembly 110 engages the cam stop diameter 96, the hub assembly 144 is in a stop diameter position.

As noted above, the motor assembly 82 preferably includes an electronic cutoff switch 139. The cutoff switch 139 is structured to stop the motor 130, and therefore the motor shaft 132, from rotating when actuated. More specifically, the cutoff switch 139 includes an elongated actuator 230 that is structured to stop said motor 130 from rotating when actuated. The cutoff switch 139 is disposed on a motor assembly side plate 136 adjacent to the hub assembly 144. Thus, the cutoff switch actuator 230 is structured to be engaged by the hub assembly 144 when the rocker arm assembly 110 moves past the cam top dead center 94 as described below.

Figure 6:
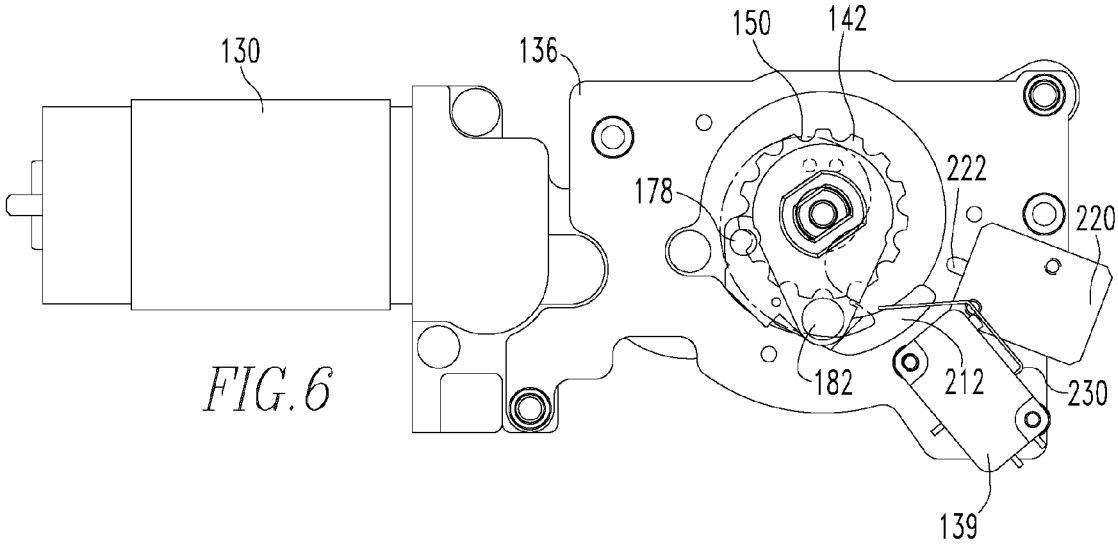
FIG. 6 shows a side view of the charging assembly with pawl in the first position.
Figure 7:
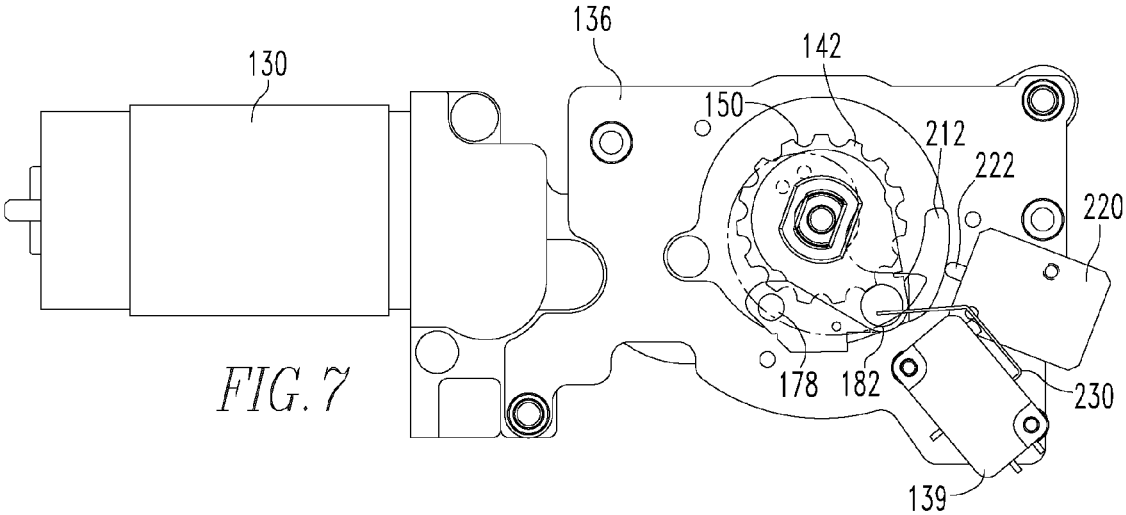
FIG. 7 shows a side view of the charging assembly with pawl in the second position.

However, in the unlikely event that the cutoff switch 139 fails to turn off the motor 130, the decoupling assembly 200 is structured to decouple the motor shaft 132 from the cam shaft 74. As set forth above, and as shown in FIG. 6, the pawl 178 is generally biased to the first position by the link assembly spring 176. The link member second end 212 is disposed on the opposite side of the link member pivot mounting 182 from the link member first end 180. Thus, the link member 172 may be pivoted in a "see-saw" like manner about the link member pivot mounting 182. To accomplish this, the lifter pin assembly 220 is positioned so that the lifter pin 222 is structured to engage the link member second end outer surface 214. When the lifter pin 222 functionally engages the link member second end outer surface 214, the link member 172 pivots about the link member pivot mounting 182 and causes the pawl 178 to move from the first position to the second position, as shown in FIG. 7. When the pawl 178 is in the second position, the pawl 178 does not engage the sprocket 142. When the pawl 178 does not engage the sprocket 142, the sprocket 142 and the hub assembly 144 are no longer fixed to each other. That is, the hub assembly 144 is selectively coupled to the sprocket 142. When the hub assembly 144 is not coupled to the sprocket 142, the hub assembly 144 "floats" on the sprocket 142. That is, if the motor 130 is operating and rotating the sprocket 142 and the hub assembly 144 when the pawl 178 moves into the second position, the sprocket 142 will continue to rotate while the hub assembly 144 remains stationary.

It is also important, however, that the pawl 178 not move into the second position prior to the rocker arm assembly 110 moving past the cam top dead center 94. That is, the pawl 178 does not move into the second position until the rocker arm assembly 110 is at, or near, the stop diameter 96. To accomplish this balance, the lifter pin assembly 220 is structured to react to the counter forces created by the at least one closing spring 61. That is, as set forth above, the at least one closing spring 61 creates a counter-force in the charging assembly 70 as the at least one closing spring 61 is being charged. This counter-force is at maximum when the rocker arm assembly 110 is at the cam top dead center 94. Through the various mechanical couplings set forth above, the counter-force acts upon the link member 172 and biases the link member 172 toward the first position. This counter-force is sufficient to overcome the bias of the lifter pin spring 224. That is, prior to the rocker arm assembly 110 moving past the cam top dead center 94, the lifter pin assembly 220 initially engages the link member second end 212 but does not cause the link member 172 to pivot. During the initial engagement, the lifter pin spring 224 is compressed and the lifter pin 222 moves into the lifter pin housing 228.

However, once the rocker arm assembly 110 moves past the cam top dead center 94 and the compression of the at least one closing spring 61 is reduced, the counter-force acting on the link member 172 is no longer sufficient to overcome the bias of the lifter pin spring 224. Thus, once the rocker arm assembly 110 moves past the cam top dead center 94, the lifter pin assembly 220 functionally engages the link member second end 212 and causes the link member 172 to pivot to the second position. In this configuration, when the rocker arm assembly 110 reaches the stop diameter 96, the link member 172, and therefore the pawl 178, are in the second position wherein the hub assembly 144 "floats" on the sprocket 142. Thus, in the unlikely event that the cutoff switch 139 fails to turn off the motor 130, the decoupling assembly 200 has decoupled the motor shaft 132 from the cam shaft 74 and any rotation of the motor shaft 132 is not transferred to the cam shaft 74.

When a user releases the latch assembly 79, the cam 76, responding to the bias of the at least one closing spring 61, rotates in the charging direction until the rocker arm assembly cam follower 116 falls off the cam tip 100 and over the step 102 to a location adjacent the point of minimal diameter 92. The rotation of the cam 76 is transferred via the cam shaft 74 to the hub assembly 144. Thus, the hub assembly 144, and therefore the link member 172, rotates slightly. The rotation of the hub assembly moves the link member second end 212 out of engagement with the lifter pin 222. When the lifter pin 222 no longer engages the link member second end 212, the bias of the link assembly spring 176 returns the link member 172 and the pawl 178 to the first position. That is, the hub assembly 144 is again coupled to the sprocket 142 and structured to rotate therewith in the charging direction, when the motor assembly 82 is used, or to rotate in the charging direction over the sprocket 142 when the handle assembly 80 is used.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A decoupling assembly for a charging assembly for an electrical switching apparatus, said charging assembly structured to couple a motor assembly shaft to a cam shaft, said cam shaft supporting a cam structured to engage and move a rocker arm assembly to charge a circuit breaker charging assembly closing spring, said cam having an outer surface with the following features in sequence, a minimal diameter, a maximum diameter identified as top dead center, a downslope, a stop diameter, and a step back to the minimal diameter, wherein as said cam rotates from a position wherein said rocker arm assembly engages said cam outer surface immediately adjacent to said minimal diameter to a position wherein said rocker arm assembly engages said cam at said top dead center, the counter-force applied to said cam shaft increases, and, as said rocker arm assembly engages said cam downslope, the counter-force applied to said cam shaft decreases, said circuit breaker further including a latch assembly structured to selectively stop the rotation of said cam when said rocker arm assembly engages said stop diameter, said decoupling assembly comprising:

a sprocket fixed to said motor shaft and structured to rotate in a charge direction, said sprocket having an outer surface with a plurality of teeth;

a hub assembly having a pawl structured to move between a first position, wherein said pawl engages said sprocket teeth, and a second position, wherein said pawl does not engage said sprocket teeth;

a lifter pin assembly having a lifter pin, said lifter pin structured to selectively move said pawl between said first position and said second position; and said hub assembly rotatably coupled to said sprocket and structured to selectively move with said sprocket when said pawl engages said sprocket teeth and to float on said sprocket when said pawl does not engage said sprocket teeth.

2. The decoupling assembly of claim 1 wherein:

said hub assembly includes a hub body and a link assembly, said link assembly including said pawl as well as a spring and an elongated link member;

said link member having a first end, a pivot mounting, and second end;

said pawl coupled to said link member at said link member first end; and said link member pivotally coupled to said hub body, said link member structured to move between a first position, wherein said pawl engages said sprocket teeth, and a second position, wherein said pawl does not engage said sprocket teeth.

3. The decoupling assembly of claim 2 wherein:

said link member first end and said link member second end are located on opposite side of said link member pivot mounting;

said lifter pin structured to engage said link member second end; and wherein, when said lifter pin functionally engages said link member second end, said link member pivots about said link member pivot mounting and moves said link member in to said second position.

4. The decoupling assembly of claim 3 wherein:

said hub assembly is disengagably fixed to said cam shaft, whereby said hub assembly rotates from a minimal diameter position, to a top dead center position, and to a stop diameter position;

wherein said hub assembly experiences a counter rotational force that is at a minimum when said hub assembly is in said minimal diameter position, at a maximum when said hub assembly is in said top dead center position, and is a reduced force when said hub assembly is in said stop diameter position;

said lifter pin assembly having a mounting and a spring, said lifter pin assembly spring disposed between said mounting and said lifter pin, said lifter pin assembly spring structured to bias said lifter pin toward said hub assembly; and said lifter pin assembly structured to initially engage said link member second end when said hub assembly is in said top dead center position and to functionally engage said link member second end when said hub assembly is in said stop diameter position.

5. The decoupling assembly of claim 1 wherein:

said hub assembly is disengagably fixed to said cam shaft, whereby said hub assembly rotates from a minimal diameter position, to a top dead center position, and to a stop diameter position;

wherein said hub assembly experiences a counter rotational force that is at a minimum when said hub assembly is in said minimal diameter position, at a maximum when said hub assembly is in said top dead center position, and is a reduced force when said hub assembly is in said stop diameter position;

said lifter pin assembly having a mounting and a spring, said lifter pin assembly spring disposed between said mounting and said lifter pin, said lifter pin assembly spring structured to bias said lifter pin toward said hub assembly; and said lifter pin assembly structured to initially engage said hub assembly when said hub assembly is in said top dead center position and to functionally engage said hub assembly when said hub assembly is in said stop diameter position.

6. A charging assembly for an electrical switching apparatus, said electrical switching apparatus having a housing assembly with side plates, said charging assembly comprising:

at least one closing spring structured to move between a charged and discharged configuration;

a rocker arm assembly pivotally coupled to said housing assembly side plate and structured to engage said at least one closing spring;

a cam shaft rotatably coupled to said housing assembly side plate and having a distal tip;

a cam disposed on said cam shaft, said cam having an outer surface with the following features in sequence, a minimal diameter, a maximum, top dead center diameter, a downslope, a stop diameter, and a step back to said minimal diameter;

a motor assembly having a motor, a motor shaft, and a cutoff switch, said motor structured to rotate said motor shaft in a charging direction, said motor shaft having a distal end, said cutoff switch having an extending actuator and structured to stop said motor from rotating when said actuator is actuated;

said motor shaft disengagably fixed to said cam shaft so that, when said cam shaft is fixed to said motor shaft, rotation of said motor shaft causes said cam to rotate;

wherein rotation of said cam causes said rocker arm assembly to engage said cam adjacent to said minimal diameter, then said cam top dead center, then said downslope, then said stop diameter, and as said cam rotates from a position wherein said rocker arm assembly engages said cam outer surface immediately adjacent to said minimal diameter to a position wherein said rocker arm assembly engages said cam at said top dead center, the counter-force applied to said cam shaft increases, and, as said rocker arm assembly engages said cam downslope and said stop diameter, the counter-force applied to said cam shaft decreases;

a latch assembly coupled to said housing assembly and structured to stop the rotation of said cam shaft when said rocker arm assembly engages said stop diameter;

a decoupling assembly disposed at the coupling of said motor shaft and said cam shaft, said decoupling assembly including a sprocket, a hub assembly, and a lifter pin assembly;

said sprocket fixed to said motor shaft and structured to rotate in a charge direction, said sprocket having an outer surface with a plurality of teeth;

said hub assembly having a pawl structured to move between a first position, wherein said pawl engages said sprocket teeth, and a second position, wherein said pawl does not engage said sprocket teeth;

said lifter pin assembly having a lifter pin, said lifter pin structured to selectively move said pawl between said first position and said second position; and said hub assembly rotatably coupled to said sprocket and structured to selectively move with said sprocket when said pawl engages said sprocket teeth and to float on said sprocket when said pawl does not engage said sprocket teeth.

7. The charging assembly of claim 6 wherein:

said hub assembly includes a hub body and a link assembly, said link assembly including said pawl as well as a spring and an elongated link member;

said link member having a first end, a pivot mounting, and second end;

said pawl coupled to said link member at said link member first end; and said link member pivotally coupled to said hub body, said link member structured to move between a first position, wherein said pawl engages said sprocket teeth, and a second position, wherein said pawl does not engage said sprocket teeth.

8. The charging assembly of claim 7 wherein:

said link member first end and said link member second end are located on opposite side of said link member pivot mounting;

said lifter pin structured to engage said link member second end; and wherein, when said lifter pin functionally engages said link member second end, said link member pivots about said link member pivot mounting and moves said link member in to said second position.

9. The charging assembly of claim 8 wherein:

said hub assembly is disengagably fixed to said cam shaft, whereby said hub assembly rotates from a minimal diameter position, to a top dead center position, and to a stop diameter position;

wherein said hub assembly experiences a counter rotational force that is at a minimum when said hub assembly is in said minimal diameter position, at a maximum when said hub assembly is in said top dead center position, and is a reduced force when said hub assembly is in said stop diameter position;

said lifter pin assembly having a mounting and a spring, said lifter pin assembly spring disposed between said mounting and said lifter pin, said lifter pin assembly spring structured to bias said lifter pin toward said hub assembly; and said lifter pin assembly structured to initially engage said link member second end when said hub assembly is in said top dead center position and to functionally engage said link member second end when said hub assembly is in said stop diameter position.

10. The charging assembly of claim 9 wherein:

said cutoff switch actuator is structured to engage, and be activated by, said hub assembly when said hub assembly is in said stop diameter position; and wherein said motor stops rotation of said sprocket when said hub assembly is in said stop diameter position and when said rocker arm assembly engages said cam stop diameter.

11. The charging assembly of claim 6 wherein:

said hub assembly is disengagably fixed to said cam shaft, whereby said hub assembly rotates from a minimal diameter position, to a top dead center position, and to a stop diameter position;

wherein said hub assembly experiences a counter rotational force that is at a minimum when said hub assembly is in said minimal diameter position, at a maximum when said hub assembly is in said top dead center position, and is a reduced force when said hub assembly is in said stop diameter position;

said lifter pin assembly having a mounting and a spring, said lifter pin assembly spring disposed between said mounting and said lifter pin, said lifter pin assembly spring structured to bias said lifter pin toward said hub assembly; and said lifter pin assembly structured to initially engage said hub assembly when said hub assembly is in said top dead center position and to functionally engage said hub assembly when said hub assembly is in said stop diameter position.

12. The charging assembly of claim 11 wherein:

said cutoff switch actuator is structured to engage, and be activated by, said hub assembly when said hub assembly is in said stop diameter position; and wherein said motor stops rotation of said sprocket when said hub assembly is in said stop diameter position and when said rocker arm assembly engages said cam stop diameter.

13. An electrical switching apparatus comprising:

a housing defining an enclosed space and having a side plate;

at least one pair of separable contacts structured to move between a first, open position, wherein the contacts are separated, and a second, closed position, wherein the contacts contact each other and are in electrical communication;

a pole shaft structured to move said at least one pair of separable contacts between said first and second positions;

a charging assembly structured to rotate said pole shaft and having at least one closing spring, a rocker arm assembly, a cam shaft, a cam, a motor assembly, a latch assembly, and a decoupling assembly;

said at least one closing spring structured to move between a charged and discharged configuration;

said rocker arm assembly pivotally coupled to said housing assembly side plate and structured to engage said at least one closing spring;

said cam shaft rotatably coupled to said housing assembly side plate and having a distal tip;

said cam disposed on said cam shaft, said cam having an outer surface with the following features in sequence, a minimal diameter, a maximum, top dead center diameter, a downslope, a stop diameter, and a step back to said minimal diameter;

said motor assembly having a motor, a motor shaft, and a cutoff switch, said motor structured to rotate said motor shaft in a charging direction, said motor shaft having a distal end, said cutoff switch having an extending actuator and structured to stop said motor from rotating when said actuator is actuated;

said motor shaft disengagably fixed to said cam shaft so that, when said cam shaft is fixed to said motor shaft, rotation of said motor shaft causes said cam to rotate;

wherein rotation of said cam causes said rocker arm assembly to engage said cam adjacent to said minimal diameter, then said cam top dead center, then said downslope, then said stop diameter, and as said cam rotates from a position wherein said rocker arm assembly engages said cam outer surface immediately adjacent to said minimal diameter to a position wherein said rocker arm assembly engages said cam at said top dead center, the counter-force applied to said cam shaft increases, and, as said rocker arm assembly engages said cam downslope and said stop diameter, the counter-force applied to said cam shaft decreases;

said latch assembly coupled to said housing assembly and structured to stop the rotation of said cam shaft when said rocker arm assembly engages said stop diameter;

said decoupling assembly disposed at the coupling of said motor shaft and said cam shaft, said decoupling assembly including a sprocket, a hub assembly, and a lifter pin assembly;

said sprocket fixed to said motor shaft and structured to rotate in a charge direction, said sprocket having an outer surface with a plurality of teeth;

said hub assembly having a pawl structured to move between a first position, wherein said pawl engages said sprocket teeth, and a second position, wherein said pawl does not engage said sprocket teeth;

said lifter pin assembly having a lifter pin, said lifter pin structured to selectively move said pawl between said first position and said second position; and said hub assembly rotatably coupled to said sprocket and structured to selectively move with said sprocket when said pawl engages said sprocket teeth and to float on said sprocket when said pawl does not engage said sprocket teeth.

14. The electrical switching apparatus of claim 13 wherein:

said hub assembly includes a hub body and a link assembly, said link assembly including said pawl as well as a spring and an elongated link member;

said link member having a first end, a pivot mounting, and second end;

said pawl coupled to said link member at said link member first end; and said link member pivotally coupled to said hub body, said link member structured to move between a first position, wherein said pawl engages said sprocket teeth, and a second position, wherein said pawl does not engage said sprocket teeth.

15. The electrical switching apparatus of claim 14 wherein:

said link member first end and said link member second end are located on opposite side of said link member pivot mounting;

said lifter pin structured to engage said link member second end; and wherein, when said lifter pin functionally engages said link member second end, said link member pivots about said link member pivot mounting and moves said link member in to said second position.

16. The electrical switching apparatus of claim 15 wherein:

said hub assembly is disengagably fixed to said cam shaft, whereby said hub assembly rotates from a minimal diameter position, to a top dead center position, and to a stop diameter position;

wherein said hub assembly experiences a counter rotational force that is at a minimum when said hub assembly is in said minimal diameter position, at a maximum when said hub assembly is in said top dead center position, and is a reduced force when said hub assembly is in said stop diameter position;

said lifter pin assembly having a mounting and a spring, said lifter pin assembly spring disposed between said mounting and said lifter pin, said lifter pin assembly spring structured to bias said lifter pin toward said hub assembly;

said lifter pin assembly structured to initially engage said link member second end when said hub assembly is in said top dead center position and to functionally engage said link member second end when said hub assembly is in said stop diameter position.

17. The electrical switching apparatus of claim 16 wherein:

said cutoff switch actuator is structured to engage, and be activated by, said hub assembly when said hub assembly is in said stop diameter position; and wherein said motor stops rotation of said sprocket when said hub assembly is in said stop diameter position and when said rocker arm assembly engages said cam stop diameter.

18. The electrical switching apparatus of claim 13 wherein:

said hub assembly is disengagably fixed to said cam shaft, whereby said hub assembly rotates from a minimal diameter position, to a top dead center position, and to a stop diameter position;

wherein said hub assembly experiences a counter rotational force that is at a minimum when said hub assembly is in said minimal diameter position, at a maximum when said hub assembly is in said top dead center position, and is a reduced force when said hub assembly is in said stop diameter position;

said lifter pin assembly having a mounting and a spring, said lifter pin assembly spring disposed between said mounting and said lifter pin, said lifter pin assembly spring structured to bias said lifter pin toward said hub assembly;

said lifter pin assembly structured to initially engage said hub assembly when said hub assembly is in said top dead center position and to functionally engage said hub assembly when said hub assembly is in said stop diameter position.

19. The electrical switching apparatus of claim 18 wherein:

said cutoff switch actuator is structured to engage, and be activated by, said hub assembly when said hub assembly is in said stop diameter position; and wherein said motor stops rotation of said sprocket when said hub assembly is in said stop diameter position and when said rocker arm assembly engages said cam stop diameter.

20. The electrical switching apparatus of claim 13 wherein said motor assembly and said decoupling assembly are coupled as a unit which may be removed from said housing assembly.

* * * * *